United States Patent [19]

Miller

[11] Patent Number: 4,620,644

[45] Date of Patent: Nov. 4, 1986

[54] TOTE BOX WITH LID CONTAINER

[75] Inventor: Daniel A. Miller, Cincinnati, Ohio

[73] Assignee: Buckhorn Material Handling Group Inc., Milford, Ohio

[21] Appl. No.: 248,270

[22] Filed: Mar. 27, 1981

[51] Int. Cl.[4] ..... B65D 43/14; B65D 21/02; B65D 51/04

[52] U.S. Cl. ..... 220/334; 206/508; 220/337; 220/DIG. 15

[58] Field of Search ..... 220/21, 334, 337, DIG. 15, 220/335; 206/508

[56] References Cited

U.S. PATENT DOCUMENTS

| | | | |
|---|---|---|---|
| 3,245,573 | 4/1966 | Bakos | 220/21 |
| 3,282,462 | 11/1966 | Box | 206/508 |
| 3,463,345 | 8/1969 | Bockanstette | 206/508 |
| 4,161,261 | 7/1979 | Frater | 206/508 |
| 4,282,983 | 8/1981 | Swartzbaush | 220/335 |

FOREIGN PATENT DOCUMENTS

| | | | |
|---|---|---|---|
| 278207 | 5/1967 | Australia | 220/DIG. 15 |
| 1089786 | 11/1980 | Canada | 206/508 |
| 1292064 | 3/1962 | France | 220/DIG. 15 |

*Primary Examiner*—George E. Lowrance
*Attorney, Agent, or Firm*—Beall Law Offices

[57] ABSTRACT

The adjacent edges for two covers of a tote box have interlocking fingers where separation is resisted by means of hooks on one or more of the covers engaging side flanges of the box to lock the covers in place. The closed covers present a flat surface inset with respect to a plurality of abutments in the vicinity of the sides and ends that prevent side shifting of a like box stacked on top of it. The side abutments have a second function of latching into the end walls to hold the covers in their open position, even when a plurality of like boxes are nested. The latches and locks are unitarily molded into the cover and provided with cam surfaces that together with inherent resiliency of the structure provide for locking and latching by movement of the cover.

23 Claims, 18 Drawing Figures

TOTE BOX WITH LID CONTAINER

BACKGROUND OF THE INVENTION

The present invention relates to boxes with covers. More particularly, the boxes are designed to be reused, are molded of synthetic resin, and provided with attached covers, with construction being such that closed boxes may be stacked for shipping and open boxes may be nested for return.

With respect to such boxes, it is desirable for the closed box to present considerable strength and rigidity as a unit, both with respect to handling and stacking when loaded. It is desirable that they stack and nest both securely and easily.

In the United States Patent to Bockenstette entitled "Lidded Tote Box", U.S. Pat. No. 3,463,345 issued 1969, these features are provided to a considerable extent. The cover elements of each box have interlocking portions to present a flat surface together with abutments around the periphery for stacking purposes and to provide for cover strength in its middle portion. With the covers swung approximately 270 degrees from their closed position, the boxes may be nested with overlapping covers for shipping purposes.

SUMMARY

It is an object of the present invention to meet the above noted requirements to a greater extent than the prior art. Although features of the present invention are applicable to boxes of quite different construction than noted above, in its most narrow aspects, the present invention is that of the preferred embodiment, which is an improvement over the above noted patented device.

The above noted patented box provides nothing other than gravity to assure that the lids stay closed. It is common practice to provide straps around such a loaded box during shipping, for security of the contents, or to provide locks that have a shackle, pin, strand or the like extending between aligned holes in a cover element and a flange associated with one of the box sides. While these latter features provide for security of the contents, particularly against pilfering, they require special purpose items not carried by the box itself, which are usually destroyed upon opening the box. The interlocking portions of adjacent overlapping cover element edges provide for considerable stability with respect to the cover elements relatively moving, which function is lost if both cover elements are not maintained in their closed position. During nesting, it is necessary to swing the cover elements through approximately 270 degrees to open the boxes, and with nesting the cover elements overlap one another. A stack of such nested boxes can be difficult to handle because the cover element will tend to fly out, that is pivot upwardly and further take up considerable room laterally when trying to tightly fit a plurality of columns of nested boxes in a confined space, such as a truck loading area. Again, ties or straps could be used or external locking devices, for the lids to maintain them in their open position tightly against the box sides, but these would be expensive, separate from the boxes themselves and therefore easily lost or not available, and time consuming for their assembly when it is realized that a very large volume of such boxes are handled daily and a small amount of time lost with respect to each box becomes a large amount of time at the end of the day with respect to such a large volume of boxes handled in one day.

The present invention provides for locks on the cover elements sides to cooperate with the box sidewall flanges automatically upon closure of the box cover, to provide the required security without any additional part separate from the box and without any lost time, in an economical manner with respect to manufacture and maintenance.

It is a further object of the present invention to provide latches that will provide for the above desired security with respect to the open box cover, which latches are automatically engaged with very little effort during opening of the boxes and little or no lost time, without requiring any parts or elements separate from the box, and in an economical manner with respect to manufacture and maintenance. The locks and latches may be easily released, do not detract from the storage volume of the box or add to the external dimensions of the box in a disadvantageous manner, and are easily reused.

BRIEF DESCRIPTION OF THE DRAWING

Further objects, features and advantages of the present invention will become more clear from the following Detailed Description of a Preferred Embodiment, wherein.

DETAILED DESCRIPTION

Figure 1:
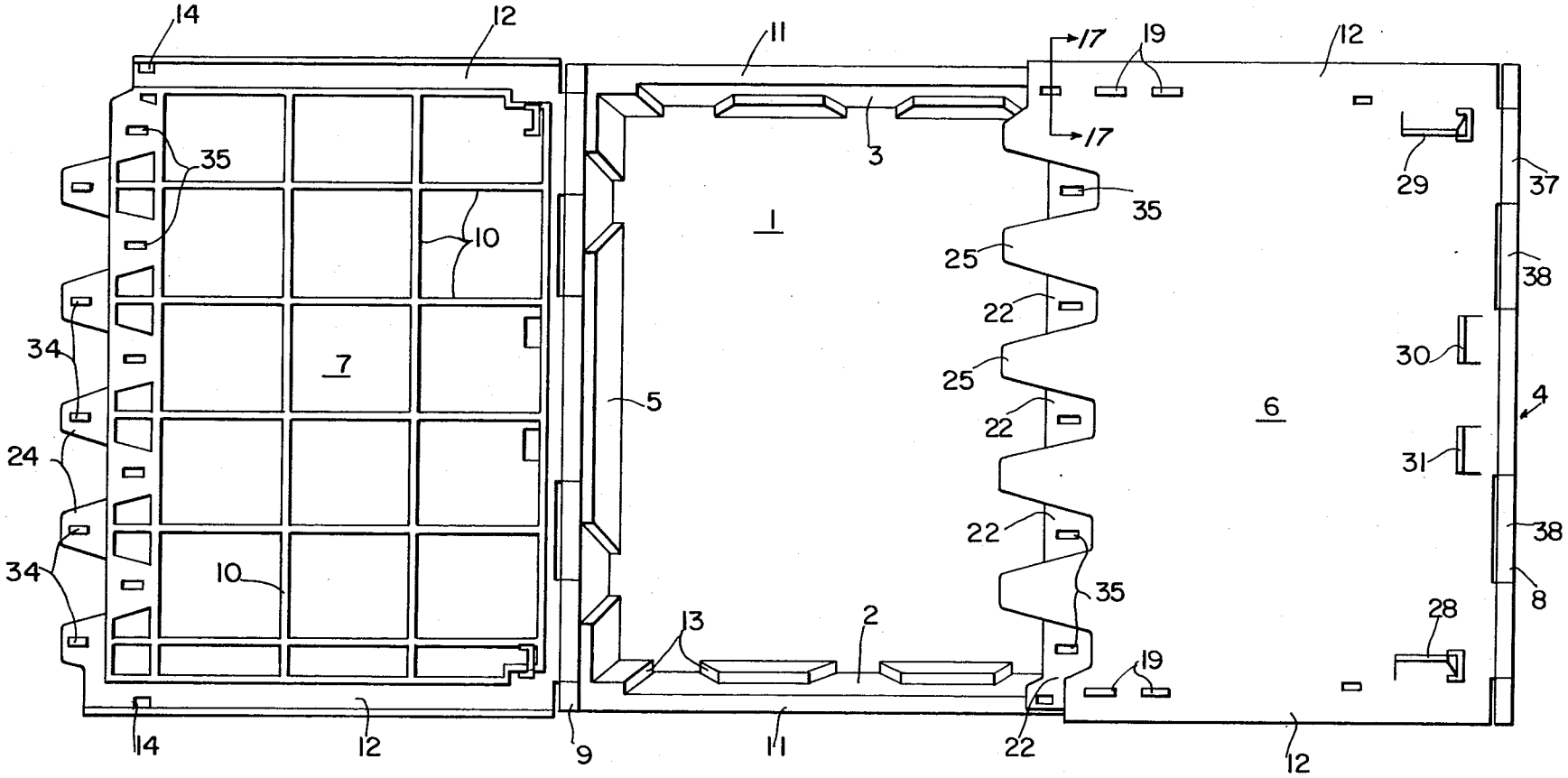
FIG. 1 is a top plan view of a box constructed according to the present invention, with one cover element closed and one cover element partially open.

In the following description and in the claims, relative terms are used with respect to the box being in its normal upright position, for purposes of relating structural elements to each other in a concise manner.

Since much of the structure of the present preferred embodiment is the same as structure in the box of the above mentioned patent, it will not be described in detail with respect to its structure, advantages, etc., herein, even though shown herein in the drawing in detail. The disclosure of the above mentioned patent is incorporated herein in its entirety, by reference.

In FIGS. 1–5, the basic box structure comprises a bottom 1 of generally rectangular shape, opposed sidewalls 2, 3, opposed end walls 4, 5, cover elements 6, 7, and hinges 8, 9, which respectively secure cover elements 6, 7 to end walls 4, 5. The bottom, sidewalls and end walls are all molded unitarily, that is as a homogeneous simultaneous molding of the same material, so that the lower ends of the side and end walls are integrally formed with the periphery of the bottom, while the side ends of the walls are integrally formed with each other, so that the entire structure forms a unitary container with an open top. As seen, each cover element partially closes this open top, while together the two cover elements completely close the open top, when they are in their closed position illustrated in FIG. 1 with respect to cover element 6, and in FIGS. 3 and 5. Each cover element 6, 7 may be swung from its closed position to an open position, illustrated with respect to cover 6 in FIG. 4 through an arc of about 270 degrees.

The underside of each cover element 6, 7 is provided with reinforcing ribs 10, which may extend in the illustrated grid to provide for beam rigidity in the cover. The uppermost edge of each of the sidewalls is provided with a flange 11, which extends generally horizontally and provides for reinforcement of the sidewalls at the top of the container. The hinge structure 8, 9, to be described in more detail below, provides for similar rigidity to the uppermost edge of each end wall. Each cover element has a side portion 12, FIG. 1, of its generally rectangular shape, that overlies the container flange 11 for supporting the cover element in the closed position. One end portion of each cover element is provided with a part of the hinge, and the other end portion of each cover element is provided with interlocking portions for mating with similar portions of the other cover element, to be described below in more detail. The sidewalls and end walls are provided with a plurality of shoulder type walls 13 joining offset portions, to provide a non-planar structure for the end walls and sidewalls to increase their rigidity, even though the end walls and sidewalls are preferably molded of a uniform thickness. The bottom 1, in use, is either supported by a support surface or the cover of a like box when stacked and therefore is not provided with any reinforcement, that is, the bottom is planar. Of course, the bottom could be provided with reinforcement, preferably on the outside, in a manner similar to the ribs 10 provided for the cover elements.

Figure 16:
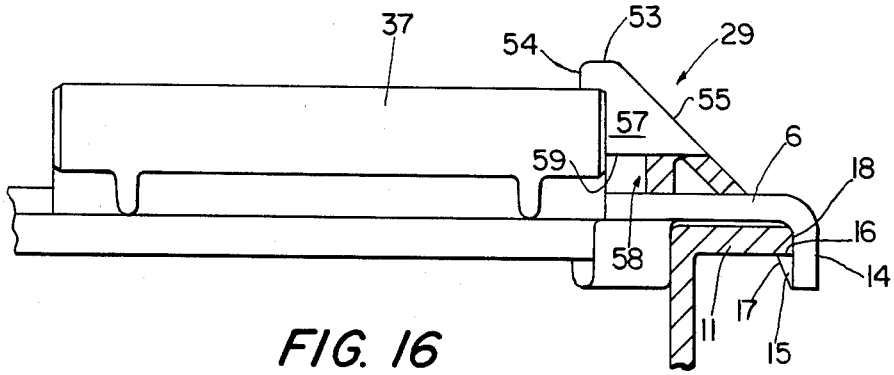
FIG. 16 is a partial cross sectional view taken along line 16—16 of FIG. 13.
Figure 17:
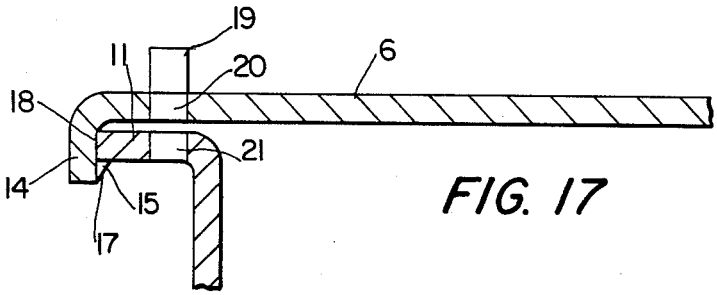
FIG. 17 is a partial cross sectional view taken along line 17—17 in FIG. 1.
Figure 18:
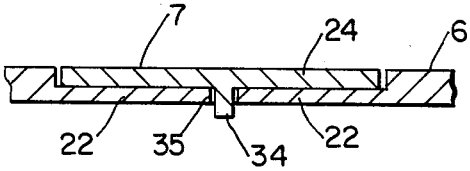
FIG. 18 is a partial cross sectional view taken along line 18—18 in FIG. 3.

For automatically locking a cover element to the container in its closed position, a hook 14 is provided as shown in FIGS. 16 and 17. Such a hook 14 could be provided with respect to both cover elements, although locking one cover element effectively locks the other cover element due to the interlocking members along the adjacent end portions of the cover elements, which will be described later. A hook element, preferably only one, is provided for each side portion 12 of the cover element 6. The hook 14 extends downwardly for only a minor part of the length of the side portion to a position below the adjacent flange 11, and then inwardly with a triangular shaped portion 15 that extends beneath the flange 11 to thereby positively prevent the cover from being lifted upwardly from its closed position, unless sufficient force is provided to resiliently bend the downwardly depending portion of the hook 14 and/or the flange 11. The hook 14 is illustrated in its relaxed locked position. The triangular shaped portion 15 of the hook forms a horizontally extending upwardly facing lock surface 16 that engages the under surface of the flange 11 and an immediately adjacent lower downwardly and outwardly extending cam surface 17 that will engage the adjacent outermost edge 18 of the flange 11 when the cover element 6 is moved about its hinge 9 from an open position into its closed position to thereby cam the hook 14 outwardly relative to the flange 11, against the inherent bias of the resilient material of the cover element and container to an unlocked position where the triangular shaped portion 15 extends outwardly from the flange 11 so that it moves downwardly pass the flange and thereafter inwardly to its illustrated position in FIG. 16.

While the hook 14 will provide for securement of the cover elements in their closed position for most purposes, it will at times be desirable to provide for a destructible securement that by its destruction will indicate the cover elements have been open, and perhaps the contents tampered with. For this purpose, one or more straps may be provided completely around the box as a conventional type of closed loop band extending between adjacent upstanding lugs 19 integrally formed on the cover element 6, in pairs along each side portion 12. Such lugs could also be provided on the other cover element and at different locations. Optionally, or in addition, holes 20 and 21 may be respectively provided in the cover element 6 and the flange 11, as shown in FIG. 17.

Figure 2:
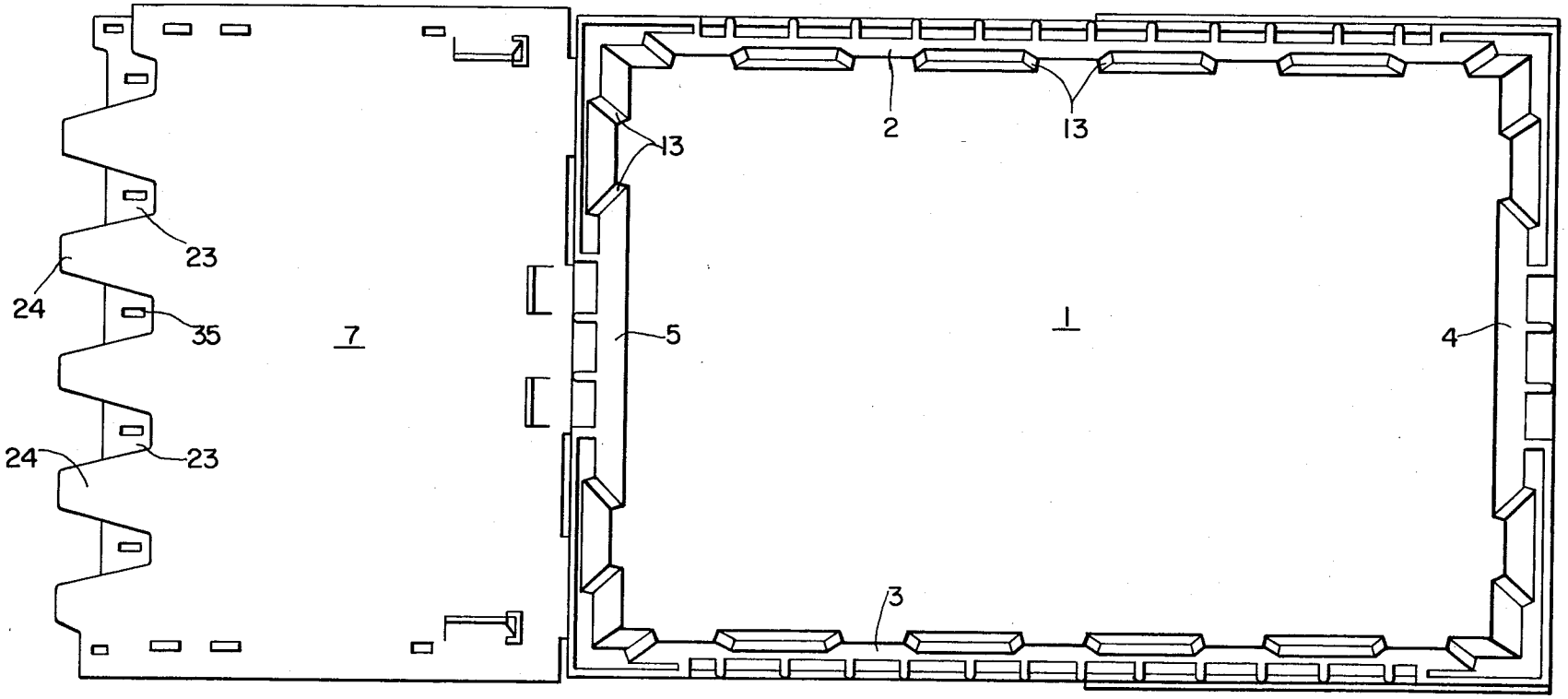
FIG. 2 is a bottom view of the box in FIG. 1.
Figure 3:
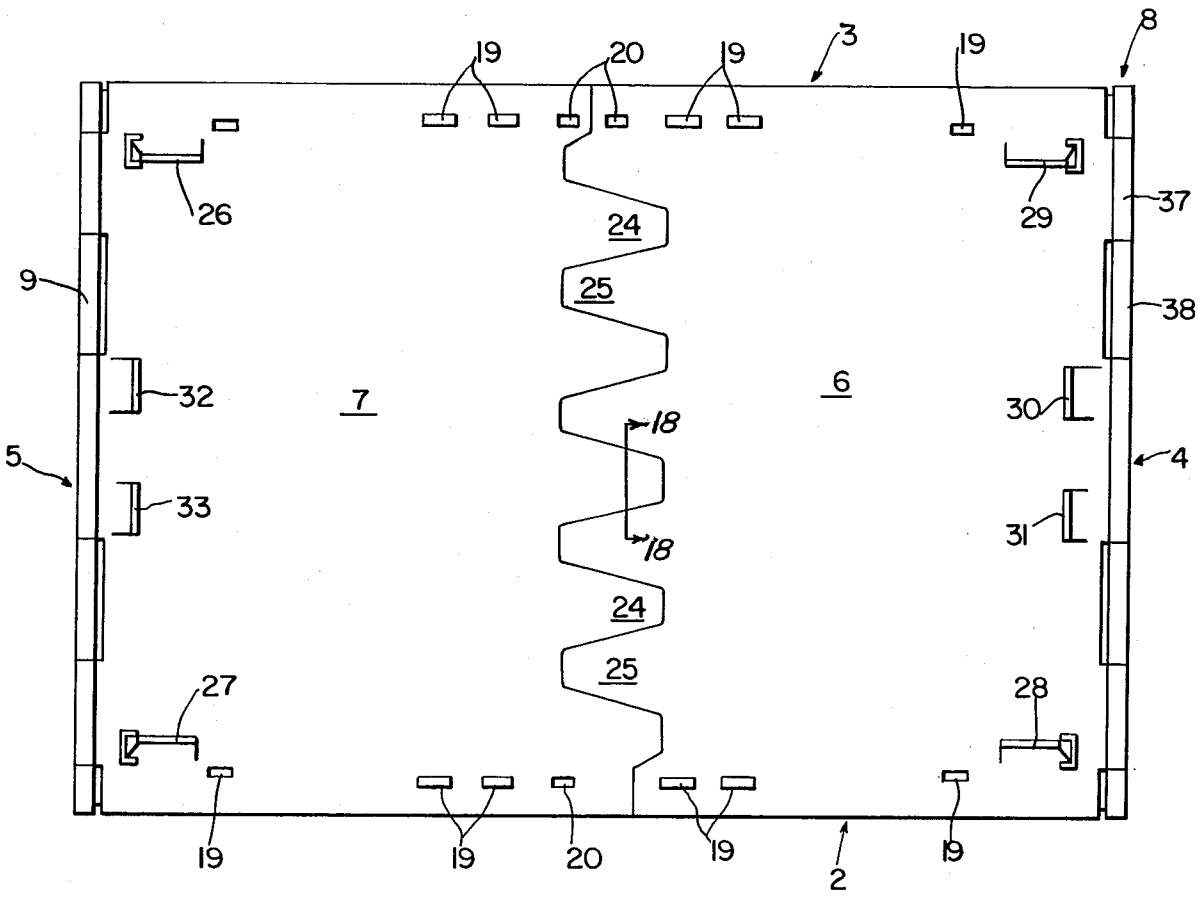
FIG. 3 is a top plan view of the box with both covers closed.
Figure 4:
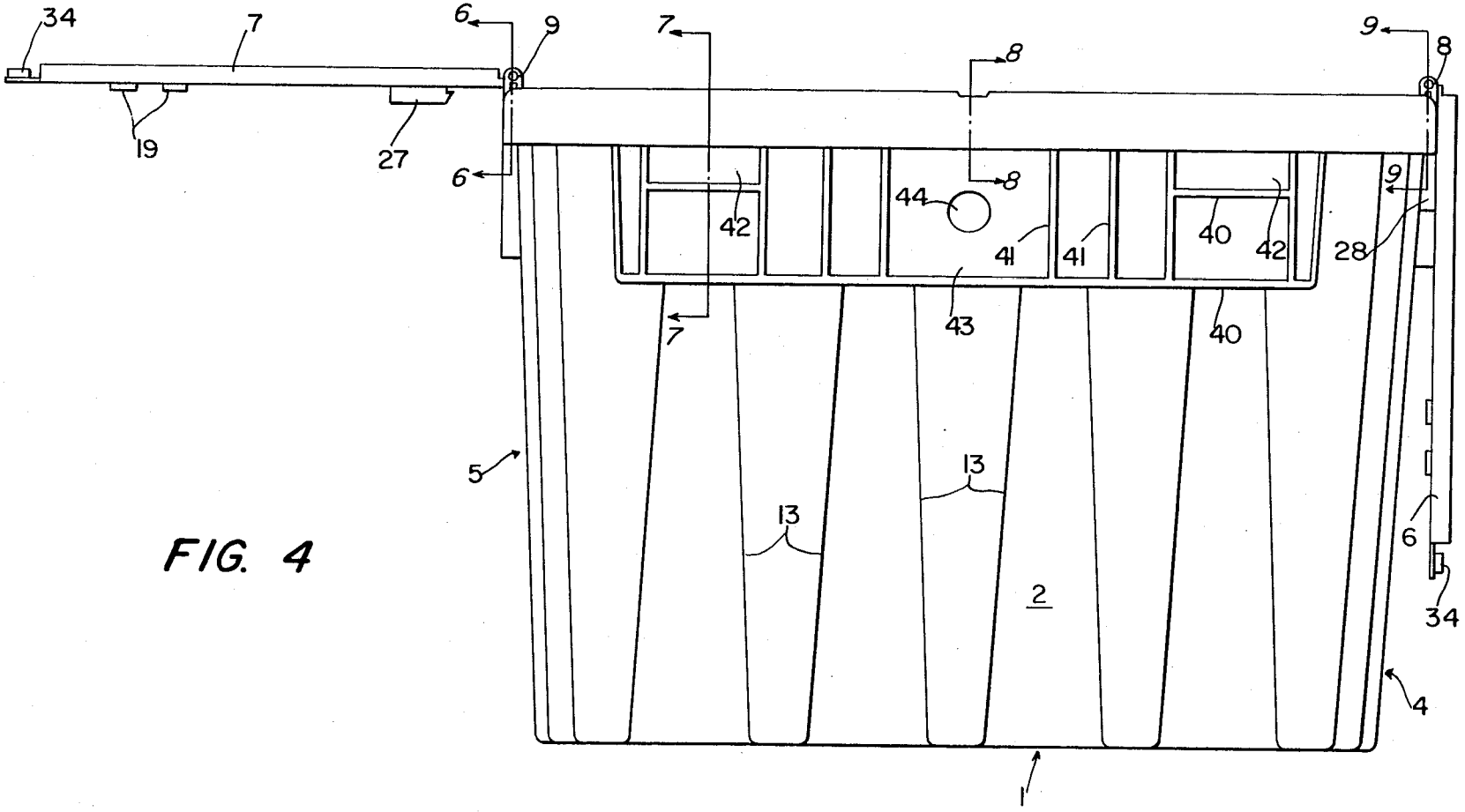
FIG. 4 is a side elevation view with one cover element completely open and the other cover element in the partially open position shown in FIG. 1.
Figure 5:
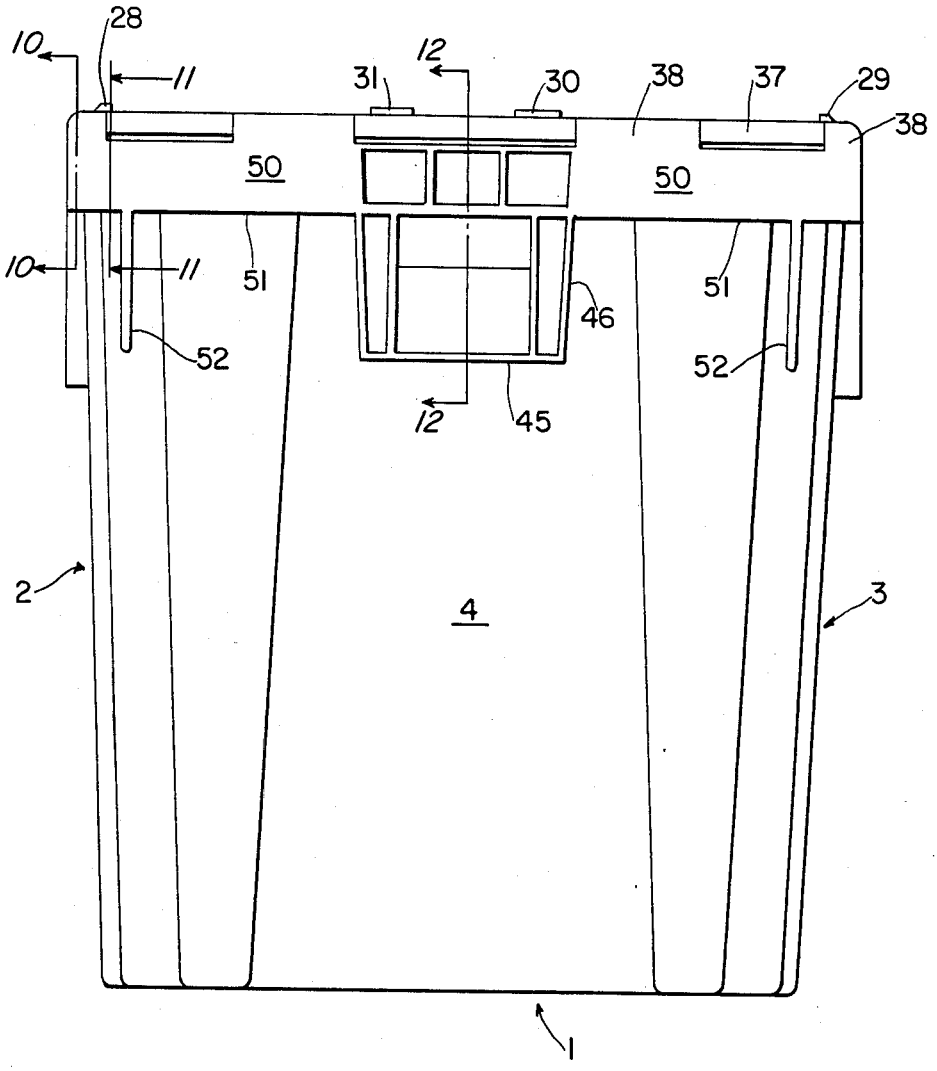
FIG. 5 is an end view of the box as shown in FIG. 3.

The cover elements 6, 7 are mechanically interlocked with each other in their closed position. For this purpose, each cover element along its end portion adjacent the other cover element is provided with a plurality of depressed areas 22 for the cover element 6 and depressed areas 23 for the cover element 7, to interdigitate with fingerlike elements 24 on the cover element 7 and 25 on the cover element 6, respectively, as best seen in FIGS. 1, 2, 3, and 18. The cover elements 6, 7 must be opened and closed concurrently for proper interdigitation, and when closed they present a single flat surface facing upwardly and in a common plane, in the mid-portion of the combined cover elements 6, 7 as seen in FIG. 3, of at least the area of the bottom 1 as seen in FIG. 2, so that a like box could be stacked upon the box with the cover elements closed as in FIG. 3. This flat surface is inset with respect to abutments around its periphery, which abutments extend vertically upwardly from the plane of the flat surface to prevent lateral shifting of the like stacked box. The abutments 26, 27, 28, 29, 30, 31, 32, 33 will be described in more detail hereinafter. The abutments 30–33 engage the adjacent end walls of the like box to prevent its relative movement perpendicular to the axes of the hinges 8, 9, while the abutments 26–29 engage the adjacent sidewalls of the like box to prevent its lateral movement in a direction parallel to the axes 8, 9.

The fingers 24, 25 interdigitating with the depressed areas 22, 23 will prevent relative movement between the cover elements 6, 7 in a directin parallel to the axes of the hinges 8, 9, as well as provide for mutual support and interlocking of the two cover elements 6, 7 with respect to beam strength in carrying a vertical load. To provide for additional interlocking, the outer end of each of the fingers 24, 25 is provided with a downwardly extending lug 34, which tightly telescopically engages within a correspondingly shaped through hole 35 in the depressed area 23, 22 of the other cover element. It is preferred that the depressed areas 22, 23 extend for substantially half the length of the fingers 24, 25, in the direction perpendicular to the axes of the hinges 8, 9. The lugs and holes 34, 35 prevent, positively, movement within the plane of the flat surface, as particularly seen with respect to FIG. 18.

Figure 6:
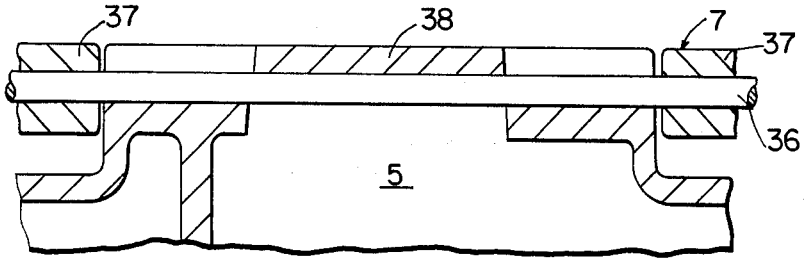
FIG. 6 is a partial cross sectional view taken along line 6—6 in FIG. 4.
Figure 8:
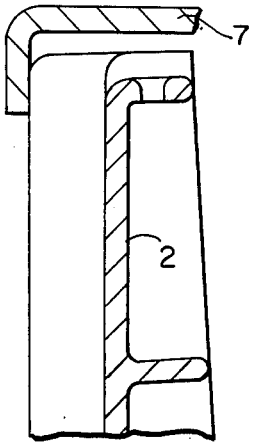
FIG. 8 is a partial cross sectional view taken along line 8—8 in FIG. 4.
Figure 9:
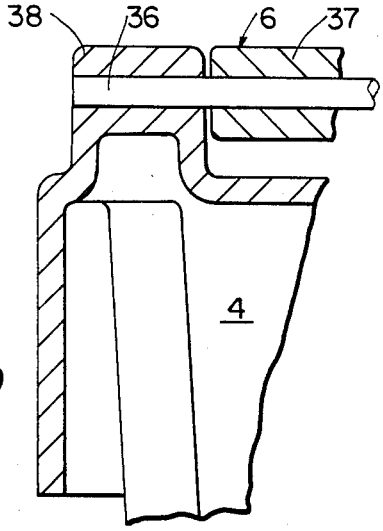
FIG. 9 is a partial cross sectional view taken along line 9—9 in FIG. 4.
Figure 10:
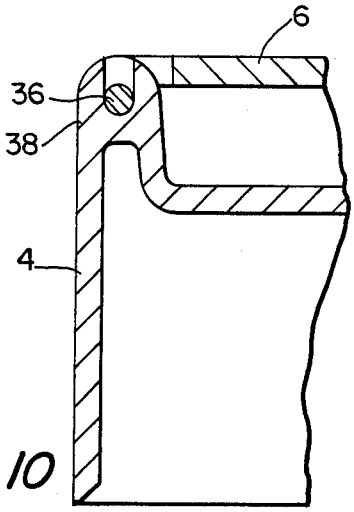
FIG. 10 is a partial cross sectional view taken along line 10—10 in FIG. 5.
Figure 13:
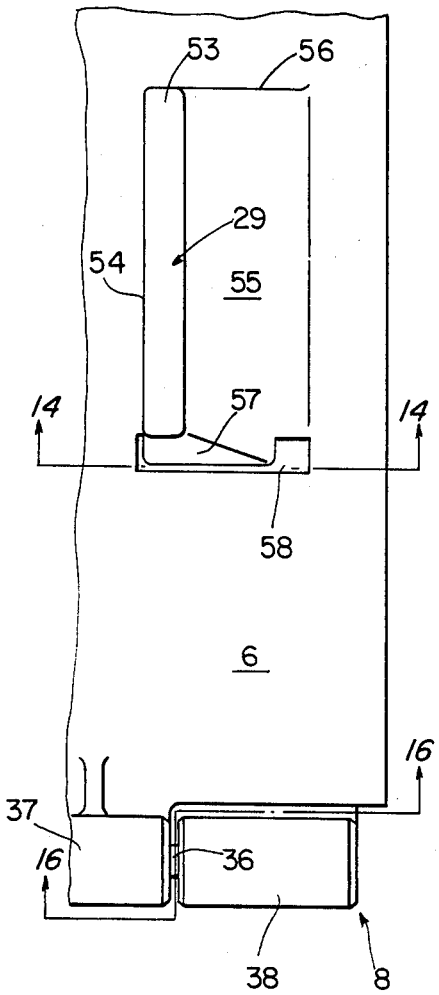
FIG. 13 is an enlarged portion of FIG. 3.
Figure 14:
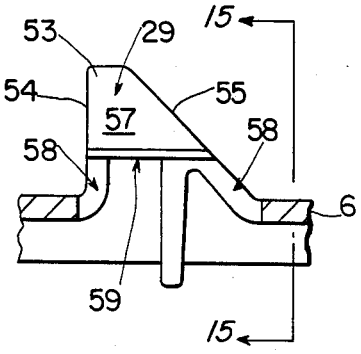
FIG. 14 is a partial cross sectional view taken along line 14—14 of FIG. 13.
Figure 15:
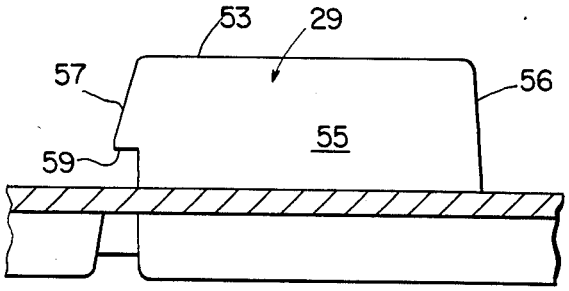
FIG. 15 is a partial cross sectional view taken along line 15—15 of FIG. 14.

The hinge for each cover element 6, 7 is substantially the same, and only one will be described with respect, particularly, to FIGS. 6, 9, and 13. Since all of the structure of each cover element is unitarily molded and all of the structural elements of the container are unitarily molded, molding relief is provided with respect to the elements of the hinge other than the hinge pin 36. The hinge pin 36 is tightly secured, by means of a force fit, in a discontinuous generally circular horizontal hole in the uppermost edge of the corresponding sidewall, to be fixed therewith and loosely received within an aligned discontinuous hole in the associated cover, for relative pivoting movement. The discontinuous hole in the cover is formed by a plurality of bosses 37, and in the sidewall by means of a plurality of bosses 38. These bosses, together, present a continuous series of outwardly, with respect to the hinge axis, opening round bottomed channels so that they may be formed by molding. The channels of the cover extend outwardly in at least two different directions, while the channels of the sidewall extend outwardly in at least two different directions, so as to confine the hinge pin 36 that is then driven into the bosses axially when the bosses are interdigitated.

Figure 7:
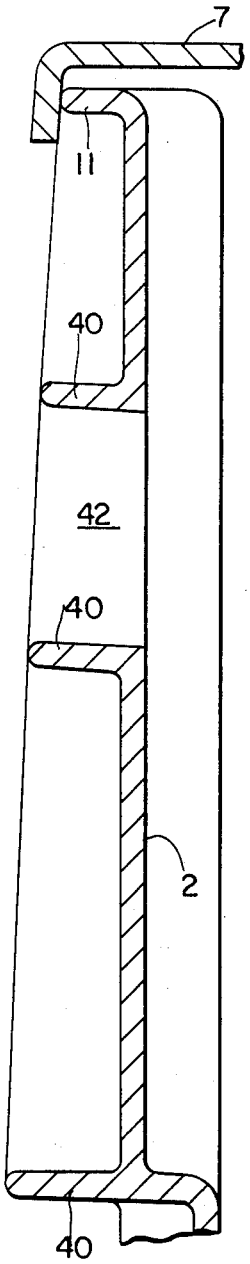
FIG. 7 is a partial cross sectional view taken along line 7—7 in FIG. 4.

The sidewalls are formed with a plurality of exterior horizontal ribs 40 and vertical ribs 41 that serve a number of functions. They reinforce the upper area of the sidewalls, form two hand hold apertures 42 for each sidewall 2, 3, engage the flange 11 of a lower nested container to limit the degree of nesting and thereby prevent jamming of the containers in their nested position, and provide an area 43 for receiving a nameplate or embossed company identification, for the user or manufacturer of the box. A hole 44 may be used to secure the nameplate, or for other purposes, or omitted. The hand hold area 42 may be completely through the sidewall 2 as shown in FIG. 7, or only a blind hole (not shown). In a similar manner, each of the end walls 4, 5 is provided with horizontal ribs 45 and vertical ribs 46 to provide a hand hold area 47 that is a blind hole, or a hand hold area 48 that is a through hole.

There is provided a mechanism to latch each of the cover elements in its open position, providing a second function for the previously mentioned abutments 26, 27, 28, 29. The mechanism will be described with respect to cover element 6, with it being understood that the mechanism is substantially the same for each of the cover elements.

A depending skirt 50 extends substantially across the entire upper portion of each end wall 4, 5 and terminates at a lower edge 51, with a buttress type bracing 52 being provided closely spaced to respective sidewalls 2, 3. Each one of the abutments 26, 27, 28, 29 has a further function of a latching member for the following structure. Each latching member is a unitary portion of the cover 6 and has walls, preferably, of the same thickness as the remainder of the cover 6, with the walls of the latching member being a top wall 53, a side vertical wall 54 that will actually form the abutment surface for the abutment function mentioned above, slanted side wall 55, end wall 56, and latch end wall 57. The cover element 6 has an aperture 58 extending completely through it to thereby form a horizontally extending, downwardly facing latching surface 59, with respect to its closed position orientation. This latching surface 59 engages behind the skirt 50 in the open position of the cover (FIG. 11) against the adjacent vertical inwardly facing latching surface 60 of the skirt 50 that is a part of the end wall 4. The aperture 58 has a dual function of providing molding clearance to form the undercut surface 59 and further to provide for resiliency in the latch end wall 57 for the following purpose. During closing of the cover element 6, the latching end wall 57 functions as a cam of wedge shape to first contact the edge 51 and drive the latching member and skirt relatively away from each other against the inherent bias of the construction material so that the latch end wall 57 may pass the edge 51 of the skirt 50 and thereafter snap under its resiliency into the overlapping position shown in FIG. 11.

The hinge element may either be on the end wall as shown or on the sidewall, and some features of the present invention are also applicable to a box having only a single cover element that completely covers the entire top of the box.

Figure 11:
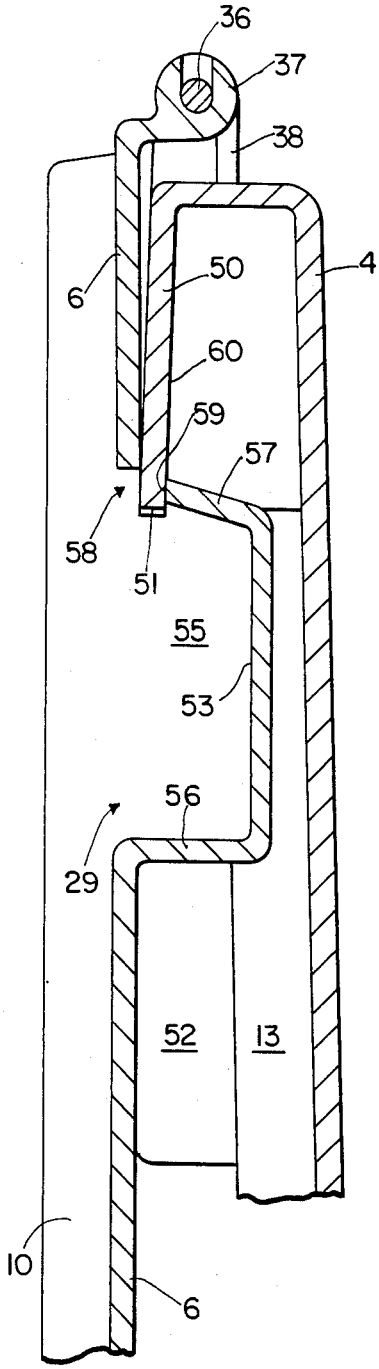
FIG. 11 is a partial cross sectional view taken along line 11—11 in FIG. 5.
Figure 12:
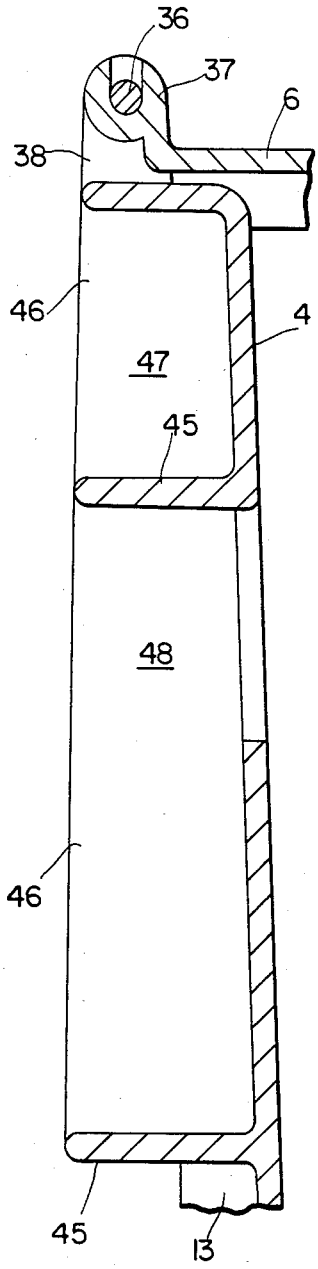
FIG. 12 is a partial cross sectional view taken along line 12—12 in FIG. 5.

The cover element 6 is easily released from its latch position of FIG. 11 by grabbing the lowermost portion and pivoting it upwardly, which bends the cover and skirt 50, so as to release the latch. Similarly, the cover element is released from its locked closed position by grabbing the furthermost portion of the cover from the hinge and lifting upwardly. Therefore, it is seen that with the camming the cover may be automatically locked and latched merely by moving it, without any special manipulation or additional parts that are not unitarily formed with the cover or container. Further, the unlatching and unlocking may be accomplished merely by the natural gripping and moving of the cover, without any additional manipulation or tools being required. It is seen that with the latching and locking respectively being accomplished closely spaced to the hinge, considerable leverage is exerted when the cover is grabbed at its position furtherest from the hinge. It is seen that the mechanism for latching and the mechanism for locking do not increase the overall exterior dimensions of the box when columns are stacked or nested boxes are closely spaced together for shipping, and similarly do not decrease the interior load carrying volume of the box. Due to the structural relationship particularly shown in FIG. 11, involving the buttress bracing 52, outwardly spaced skirt 50, and latch, a plurality of boxes may be nested together with all of the covers in their latched position, since latching does not in anyway interfere with nesting. Furthermore, it is noted that the cover as shown in FIG. 11 extends vertically in its latched open position; if the latching were not provided, the cover might extend downwardly and outwardly at an angle to increase the end to end dimension of one or a column of nested boxes, which would be a disadvantage when trying to load a plurality of nested columns in a truck, for example. With the present invention, this cannot happen. Therefore, there is considerable cooperation between the latching in general and the specific latching structure for the nesting feature as described above and for the stacking feature wherein the latching element performs a dual function of abutment in cooperation with the inset flat stacking surface. Similarly, the locking structure for the cover element in its closed position cooperates with the stacking ability of the box and its interdigitated strength by securely holding the cover elements in their interdigitated position.

While a preferred embodiment has been specifically described in detail as required for illustrating the best mode of the present invention and further for the specific advantages of the details, variations and modifications have been mentioned and further variations, modifications and embodiments are contemplated according to the broader aspects of the present invention, all as determined by the spirit and scope of the following claims.

What is claimed is:

1. A tote box, comprising:

a bottom of generally rectangular shape around its periphery;

opposed side and opposed end walls sloping downwardly and inwardly to said bottom, each wall having lower ends integrally formed with the periphery of said bottom and side ends integrally formed with each other to form with the bottom a unitary container having an open top;

two cover elements closing the open top of said container in closed position;

hinge means along the uppermost edge of each of said end walls and along one edge of each of said cover elements for respectively hingedly securing said each cover element to said container for pivotal movement about respective axes from said closed position through about 270 degrees to an open position;

the uppermost edge of said side walls having an integral flange with an outermost downwardly facing lock surface;

each of said cover elements being generally rectangular with opposed end portions, one of which having said hinge means, and opposed side portions overlying said container flange for supporting said cover element in said closed position;

each of said side portions of one of said cover elements at a location adjacent its end portion that is opposite its hinge means having a downwardly extending unitary hook means resiliently movable between a lock position extending beneath said flange lock surface to prevent movement of said cover elements from said closed position toward said open position and an unlocked position outwardly spaced from said flange to permit pivotal movement of said cover elements from said closed position toward said open position; said hook means being inherently biased from said unlocked position to said lock position;

each said hook means having a horizontally extending upwardly facing lock surface underlying said flange lock surface in said lock position, and an immediately adjacent lower downwardly and outwardly extending cam surface means that will engage the adjacent outermost edge of said flange when said cover element is moved about said hinge means into its closed position to thereby cam said hook means from its lock position to its unlocked position against said bias to correspondingly move outwardly of and past said flange as said cover element moves into its closed position, so that said hook means thereafter resiliently moves from its unlocked position to its lock position when said cover element is in its closed position to lock said cover element;

said cover elements overlapping in the region of the middle of said box top, in their closed positions and the end portions of said cover elements within the vicinity of said overlap having complementary raised and depressed areas, the depressed areas being about one-half the length of the raised areas, said areas interfitting with each other when said cover elements are closed, to present an upwardly facing flat surface, inset with respect to the upper edges of said side and end walls, whereby a like box may be stacked thereon and may be confined against lateral movement;

wherein at least some of the interfitting raised and depressed areas have mechanically interlocking means interlocking by cover element movement immediately prior to attaining said first position during closing of the cover elements, which movement is substantially perpendicular to said flat surface;

said mechanically interlocking means positively preventing relative movement of said cover elements within the plane of said flat surface away from each other in the direction perpendicular to said hinge means axes;

at least one of said mechanically interlocking means and said interfitting areas positively preventing relative movement between said cover element in the plane of said surface toward each other in the direction perpendicular to said hinge axes; and the other of said cover elements on each of its side portions having, at a location adjacent its end portion that is opposite its hinge means and adjacent the respective hook means of said one cover element, an aperture aligned with an aperture in said container flange providing means receiving a security element preventing movement thereat between said one cover element and said container so that said interfitting areas will thereby prevent horizontal movement thereat between said other cover element and said container to prevent disengagement of said hook means when the security element is present.

2. A tote box, comprising:

a bottom of generally rectangular shape around its periphery;

opposed side and opposed end walls, each having lower ends integrally formed with the periphery of said bottom and side ends integrally formed with each other to form with the bottom a unitary container having an open top;

at least one cover element having a generally flat surface at least partially closing the open top of said container in closed position;

hinge means along the uppermost edge of one of said end walls and along one edge of said cover element for hingedly securing said cover element to said container for pivotal movement about an axis from said closed position through about 270 degrees to an open position;

said cover element being generally rectangular with opposed end portions, one of which having said hinge means, and opposed side portions;

said side portions overlying said container uppermost edge of said side walls for supporting said cover element in said closed position;

said cover element including at least one latching member extending upwardly adjacent said flat surface and above the plane of said flat surface in said closed position;

said latching member including latch means having a first latching surface facing downward, generally horizontally, and generally parallel to and above said flat surface, when its cover element is in said closed position;

said one end wall having a vertically facing edge and an adjacent vertical, inwardly facing second latching surface vertically overlapping said latch means first latching surface in said open position of the said cover element to positively engage and obstruct movement of said cover element from said open position toward said closed position.

3. The box according to claim 2, wherein said side and end walls slope downwardly and inwardly to said bottom;

and including a plurality of identical ones of said containers so dimensioned and constructed that, with each cover element in its open position, identical boxes will telescopically nest with each upper box cover element overlapping the corresponding cover element of the adjacent lower box;

each box including a second cover element generally a mirror image of said first cover element; and second hinge means mounting said second cover element on the end wall opposite said one end wall so as to be movable about a second hinge axis between a closed position that together with said first-mentioned cover element completely closes said container and a second open position about 270 degrees pivotally from said first position.

4. The box according to claim 3, wherein said latch means includes a wedge-shaped cam portion generally outwardly facing and vertically spaced above said latch means latching surface in the closed position of said cover element for engaging said vertically facing edge and camming, vertically, said latch means and edge vertically away from each other to permit said overlapping of said latching surfaces as said cover element approaches said open position from said closed position.

5. The box according to claim 4, wherein said latching members are respectively closely adjacent the four corners of the top of said box;

said hinge means each extend upwardly above the plane of said flat surface to present end abutment means for preventing horizontal substantial movement relatively between said box and a like box stacked on top of said box in a direction perpendicular to said hinge means axes by engaging the end walls of said like box adjacent the bottom of said like box, when said cover elements are in said closed position; and said latching members engaging the side walls of said likd box adjacent its bottom for preventing horizontal substantial movement of said like box relative to said box in a direction parallel to said hinge means axes, when said cover elements are in said closed position.

6. The box according to claim 5, further including a through aperture in said cover element immediately vertically below said first latching surface of said latching means to provide molding clearance for forming said latching surface and further to provide sufficient resiliency in the attachment of said first latching surface to its cover element for said camming.

7. The box according to claim 4, further including a through aperture in said cover element immediately vertically below said first latching surface of said latching means to provide molding clearance for forming said latching surface and further to provide sufficient resiliency in the attachment of said first latching surface to its cover element for said camming.

8. The box according to claim 3, including a second cover element generally a mirror image of said first cover element;

second hinge means mounting said cover element on the end wall opposite said one end wall so as to be movable about a hinge axis between a closed position that together with said first-mentioned cover element completely closes said container and a open position about 270 degrees pivotally from said closed position.

9. The box according to claim 8, wherein said latch means includes a wedge-shaped cam portion generally outwardly facing and vertically spaced above said latch means latching surface in the closed position of said cover element for engaging said vertically facing edge and camming, vertically, said latch means and edge vertically away from each other to permit said overlapping of said latching surfaces as said cover element approaches said open position from said closed position.

10. The box according to claim 9, further including a through aperture in said cover element immediately vertically below said first latching surface of said latching member to provide molding clearance for forming said latching surface and further to provide sufficient resiliency in the attachment of said first latching surface to its cover element for said camming.

11. The box according to claim 10, wherein said latching members are respectively closely adjacent the four corners of the top of said box;

said hinge means each extend upwardly above the plane of said flat surface to present end abutment means for preventing horizontal substantial movement relatively between said box and a like box stacked on top of said box in a direction perpendicular to said hinge means axes by engaging the end walls of said like box adjacent the bottom of said like box, when said cover elements are in said closed position; and said latching members engaging the side walls of said like box adjacent its bottom for preventing horizontal substantial movement of said like box relative to said box in a direction parallel to said hinge means axes, when said cover elements are in said closed position.

12. The box according to claim 9, wherein said latching members are respectively closely adjacent the four corners of the top of said box;

said hinge means each extend upwardly above the plane of said flat surface to present end abutment means for preventing horizontal substantial movement relatively between said box and a like box stacked on top of said box in a direction perpendicular to said hinge means axes by engaging the end walls of said like box adjacent the bottom of said like box, when said cover elements are in said closed position; and said latching members engaging the side walls of said like box adjacent its bottom for preventing horizontal substantial movement of said like box relative to said box in a direction parallel to said hinge means axes, when said cover elements cover elements are in said closed position.

13. The box according to claim 8, wherein said latching members are respectively closely adjacent the four corners of the top of said box;

said hinge means each extend upwardly above the plane of said flat surface to present end abutment means for preventing horizontal substantial movement relatively between said box and a like box stacked on top of said box in a direction perpendicular to said hinge means axes by engaging the end walls of said like box adjacent the bottom of said like box, when said cover elements are in said closed position; and said latching members engaging the side walls of said like box adjacent its bottom for preventing horizontal substantial movement of said like box relative to said box in a direction parallel to said hinge means axes, when said cover elements are in said closed position.

14. The box according to claim 2, wherein said latch includes a wedge-shaped cam portion generally outwardly facing and vertically spaced above said latch latching surface in the closed position of said cover element for engaging said edge and camming, vertically, said latch and edge vertically away from each other to permit said overlapping of said latching surfaces as said cover element approaches said second position from said first position.

15. The box according to claim 14, wherein a second latching member substantially identical to said first latching member, said latching members being respectively adjacent the opposite side walls on said cover element, so that said latching members constitute abutment means adapted to abut the side walls of a like box adjacent the bottom of said like box when the said cover element is in said closed position and the like box is stacked on said box so as to have its bottom engaging and supportingly resting upon said flat surface.

16. The box according to claim 15, further including a through aperture in said cover element immediately vertically below said first latching surface of said latching means to provide molding clearance for forming said latching surface and further to provide sufficient resiliency in the attachment of said first latching surface to its cover element for said camming.

17. The box according to claim 14, further including a through aperture in said cover element immediately vertically below said first latching surface of said latching means to provide molding clearance for forming said latching surface and further to provide sufficient resiliency in the attachment of said first latching surface to its cover element for said camming.

18. The box according to claim 2, wherein a second latching member substantially identical to said first latching member, said latching members being respectively adjacent the opposite side walls on said cover element, so that said latching members constitute abutment means adapted to abut the side walls of a like box adjacent the bottom of said like box when the said cover element is in said closed position and the like box is stacked on said box so as to have its bottom engaging and supportingly resting upon said flat surface.

19. The box according to claim 4, wherein said cover element includes a plurality of abutment means, at least one of which being said latching member, extending upwardly above the plane of said flat surface for preventing horizontal substantial movement relatively between said box and a like box stacked on top of said box in any direction by engaging the end walls and side walls of said like box adjacent the bottom of said like box, when said cover elements are in said closed position.

20. The box according to claim 19, further including a through aperture in said cover element immediately vertically below said first latching surface of said latching means to provide molding clearance for forming said latching surface and further to provide sufficient resiliency in the attachment of said first laching surface to its cover element for said camming.

21. The box according to claim 10, wherein said cover element includes a plurality of abutment means, at least one of which being said latching member, extending upwardly above the plane of said flat surface for preventing horizontal substantial movement relatively between said box and a like box stacked on top of said box in any direction by engaging the end walls and side walls of said like box adjacent the bottom of said like box, when said cover elements are in said closed position.

22. The box according to claim 9, wherein said cover element includes a plurality of abutment means, at least one of which being said latching member, extending upwardly above the plane of said flat surface for preventing horizontal substantial movement relatively between said box and a like box stacked on top of said box in any direction by engaging the end walls and side walls of said like box adjacent the bottom of said like box, when said cover elements are in said closed position.

23. The box according to claim 8, wherein said co-er element includes a plurality of abutment means, at least one of which being said latching member, extending upwardly above the plane of said flat surface for preventing horizontal substantial movement relatively between said box and a like box stacked on top of said box in any direction by engaging the end walls and side walls of said like box adjacent the bottom of said like box, when said cover elements are in said closed position.

* * * * *